US008215404B2

(12) United States Patent
Makowiecki et al.

(10) Patent No.: US 8,215,404 B2
(45) Date of Patent: Jul. 10, 2012

(54) STAGE CEMENTING TOOL

(75) Inventors: Gary Makowiecki, Duncan, OK (US); Don Smith, Wilson, OK (US); Donald Winslow, Duncan, OK (US); Frank Acosta, Duncan, OK (US)

(73) Assignee: Halliburton Energy Services Inc., Duncan, OK (US)

( * ) Notice: Subject to any disclaimer, the term of this patent is extended or adjusted under 35 U.S.C. 154(b) by 525 days.

(21) Appl. No.: 12/371,374

(22) Filed: Feb. 13, 2009

(65) Prior Publication Data

US 2010/0206572 A1 Aug. 19, 2010

(51) Int. Cl.
*E21B 34/14* (2006.01)

(52) U.S. Cl. ..... 166/332.1; 106/177.4

(58) Field of Classification Search ..... 166/332.1, 166/177.4, 285, 289
See application file for complete search history.

(56) References Cited

U.S. PATENT DOCUMENTS

| | | | | |
|---|---|---|---|---|
| 2,925,865 | A | 2/1960 | Oliver | |
| 3,768,556 | A | 10/1973 | Baker | |
| 4,479,545 | A | 10/1984 | Eley | |
| 4,669,541 | A | 6/1987 | Bissonnette | |
| 4,880,058 | A | 11/1989 | Lindsey et al. | |
| 5,038,862 | A | 8/1991 | Giroux et al. | |
| 5,044,444 | A | 9/1991 | Coronado | |
| 5,109,925 | A * | 5/1992 | Stepp et al. | 166/184 |
| 5,178,216 | A | 1/1993 | Giroux et al. | |
| 5,277,253 | A | 1/1994 | Giroux et al. | |
| 5,279,370 | A | 1/1994 | Brandell et al. | |
| 5,314,015 | A | 5/1994 | Streich et al. | |
| 5,526,878 | A | 6/1996 | Duell et al. | |
| 5,641,021 | A | 6/1997 | Murray et al. | |
| 6,622,798 | B1 | 9/2003 | Rogers et al. | |
| 6,651,743 | B2 | 11/2003 | Szarka | |
| 7,086,479 | B2 | 8/2006 | Schultz et al. | |
| 7,150,326 | B2 * | 12/2006 | Bishop et al. | 166/373 |
| 2010/0051276 | A1 | 3/2010 | Rogers et al. | |

OTHER PUBLICATIONS

International Search Report and the Written Opinion of the International Searching Authority dated Dec. 6, 2010, in PCT Application PCT/GB2010/001570.
1964 Halliburton Sales and Service Catalog, pp. 42-43.
Images from Halliburton Sales Manual (5 sheets) (undated but admitted to be prior art).
International Search Report and Written Opinion of the International Searching Authority filed in corresponding PCT application PCT/GB2010/000257 dated Aug. 20, 2010.
Weatherford International Ltd., Houston, TX, Flyer titled "POST (TM) Pack-Off Stage Tool" (2008).

* cited by examiner

*Primary Examiner* — Brad Harcourt
(74) *Attorney, Agent, or Firm* — John W. Wustenberg; McAfee & Taft

(57) ABSTRACT

A cementing tool for use in a well has a housing and a closing sleeve received thereabout. An operating sleeve is received in the housing and is interconnected with the closing sleeve so that movement in the operating sleeve will cause the closing sleeve to move. The closing sleeve is detachably connected to the housing and is movable from the first or open position to a second or closed position in which it covers cementing ports defined in the housing. The tool has a plurality of lock rings that are moved with the closing sleeve. A plurality of locking grooves are adapted to receive the lock rings such that the engagement of any of the lock rings with any of the locking grooves will prevent the closing sleeve from moving out of the closed position.

28 Claims, 11 Drawing Sheets

STAGE CEMENTING TOOL

BACKGROUND OF THE INVENTION

The present invention relates generally to casing valves for use in the casing of a well, and more particularly, but not by way of limitation, to cementing tools constructed for placement in a well casing.

In the drilling of deep wells, it is often desirable to cement the casing in the well bore in separate stages, beginning at the bottom of the well and working upward.

This process is achieved by placing cementing tools, which are primarily valved ports, in the casing or between joints of casing at one or more locations in the well bore, flowing cement through the bottom of the casing, up the annulus to the lowest cementing tool, closing off the bottom, opening the cementing tool, and then flowing cement through the cementing tool up the annulus to the next upper stage and repeating this process until all stages of cementing the well are completed.

Some prior art cementing tools used for multi-stage cementing have two internal sleeves, both of which are shear-pinned initially in an upper position, closing the cementing ports in the tool. To open the cementing ports, a plug is flowed down the casing and seated on the lower sleeve. Fluid pressure is then increased in the casing until sufficient force is developed on the plug and sleeve to shear the shear pins and move the lower sleeve to the position uncovering the cementing ports. Cement is then flowed down the casing and out the ports into the annulus. When the predetermined desired amount of cement has been flowed into the annulus, another plug is placed in the casing behind the cement and flowed down the casing to seat on the upper sleeve. The pressure is increased on the second plug until the shear pins holding it are severed and the upper sleeve is moved down to close the cementing ports. One such cementing tool of this type is disclosed in Baker U.S. Pat. No. 3,768,556, assigned to the assignee of the present invention.

An external sleeve cementing tool which uses a mechanical inner locking means between an inner operating sleeve and an outer closure sleeve is disclosed in Giroux et al. U.S. Pat. No. 5,038,862 (the '862 patent), assigned to the assignee of the present invention. This external sleeve cementing tool is particularly useful in completing stage cementing of slim hole oil and gas wells. Slim hole completions involve using casing inside relatively small hole sizes to reduce the cost of drilling the well. In other words, the well annulus between the borehole and the casing is relatively small.

It is important that the sleeve utilized to close, or block the cementing port remain in the closed position, so that after the cementing operation is complete, any plugs in the casing can be drilled out, and fracturing/stimulating can be performed with no leakage. Current external sleeve cementing tools, like that shown in the '862 patent, include exposed locking grooves that may become partially filled with debris, thus preventing proper engagement of lock rings. If the closing sleeve does not properly lock in the closed position, drill-out and/or pressure created during stimulation treatments can push the sleeve open so the stimulation fluid leaks through the cementing port. The leakage can damage the integrity of the cement, negatively impact the stimulation treatment, and can cause the breakdown of zonal isolation.

SUMMARY OF THE INVENTION

A cementing tool for use in a well is disclosed. The cementing tool may be used for a stage cementing operation in which a casing is cemented into a well in stages. The cementing tool may be utilized to cement a portion of the casing thereabove where cement has been previously displaced into a well annulus casing below the stage cementing tool. The cementing tool has a housing which defines a central flow passage and has at least one cementing port in a wall thereof. A closing sleeve is received about the housing and is movable from a first or open position to a second or closed position. In the open position, the closing sleeve does not cover the at least one cementing port and in the second or closed position, the closing sleeve covers the at least one cementing port to prevent flow of cement or other fluid therethrough.

The cementing tool includes a lock member movable with the closing sleeve and engagable with a locking receptacle. When the lock member engages the locking receptacle, which may be a locking groove, it will prevent the closing sleeve from moving out of the closed position. The tool may have a plurality of lock members movable with and preferably carried by the closing sleeve. A plurality of locking receptacles is adapted to receive the lock members. Once the closing sleeve is in the closed position, the engagement of any of the lock members with any of the locking receptacles will prevent the upward movement of the closing sleeve to prevent the closing sleeve from moving out of the closed position.

In one disclosed embodiment, the plurality of locking receptacles are defined on the outer surface of the housing and are longitudinally spaced locking grooves. The lock members, which may be for example lock rings, are carried by the closing sleeve and are likewise longitudinally spaced.

In the open position of the closing sleeve the locking receptacles are protected from the well bore since they are covered by the closing sleeve. Thus, the closing sleeve will prevent the buildup of debris in the locking receptacles and provide a clean receptacle for receiving the lock members when the closing sleeve moves from the open to the closed position. The locking system may be referred to as a redundant locking system since, once the closing sleeve has reached the closed position, the engagement of any of the lock members with any of the locking receptacles will prevent the movement of the closing sleeve out of the closed position. The locking system may likewise be referred to as a protected, or isolated system, since the receptacles for the locking members are covered by the closing sleeve, and thus isolated from the wellbore. Thus, the tool has a reliable locking system to prevent the closing sleeve from moving upwardly to uncover the cementing port after it has moved into a closed position. The locking system herein will thus aid in preventing leakage through the cementing ports during treatment of the well after the plugs and cement in the cemented casing have been drilled out.

BRIEF DESCRIPTION OF THE DRAWINGS

FIG. 6 is a cross-section view of the tool with the closing sleeve moved a full travel distance.

DESCRIPTION OF A PREFERRED EMBODIMENT

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not limit the scope of the present invention.

The terms "upper and lower" and "top and bottom" as used herein are relative terms and are intended to apply to the respective positions within a particular well bore while the term "levels" or "intervals" is meant to refer to respective spaced positions along the well bore. The term "zone" is used herein to refer to separate parts of the well designated for treatment and includes an entire hydrocarbon formation or even separate portions of the same formation and horizontally and vertically spaced portions of the same formation. As used herein, "down," "downward" or "downhole" refer to the direction in or along the well bore from the wellhead.

Figure 1:
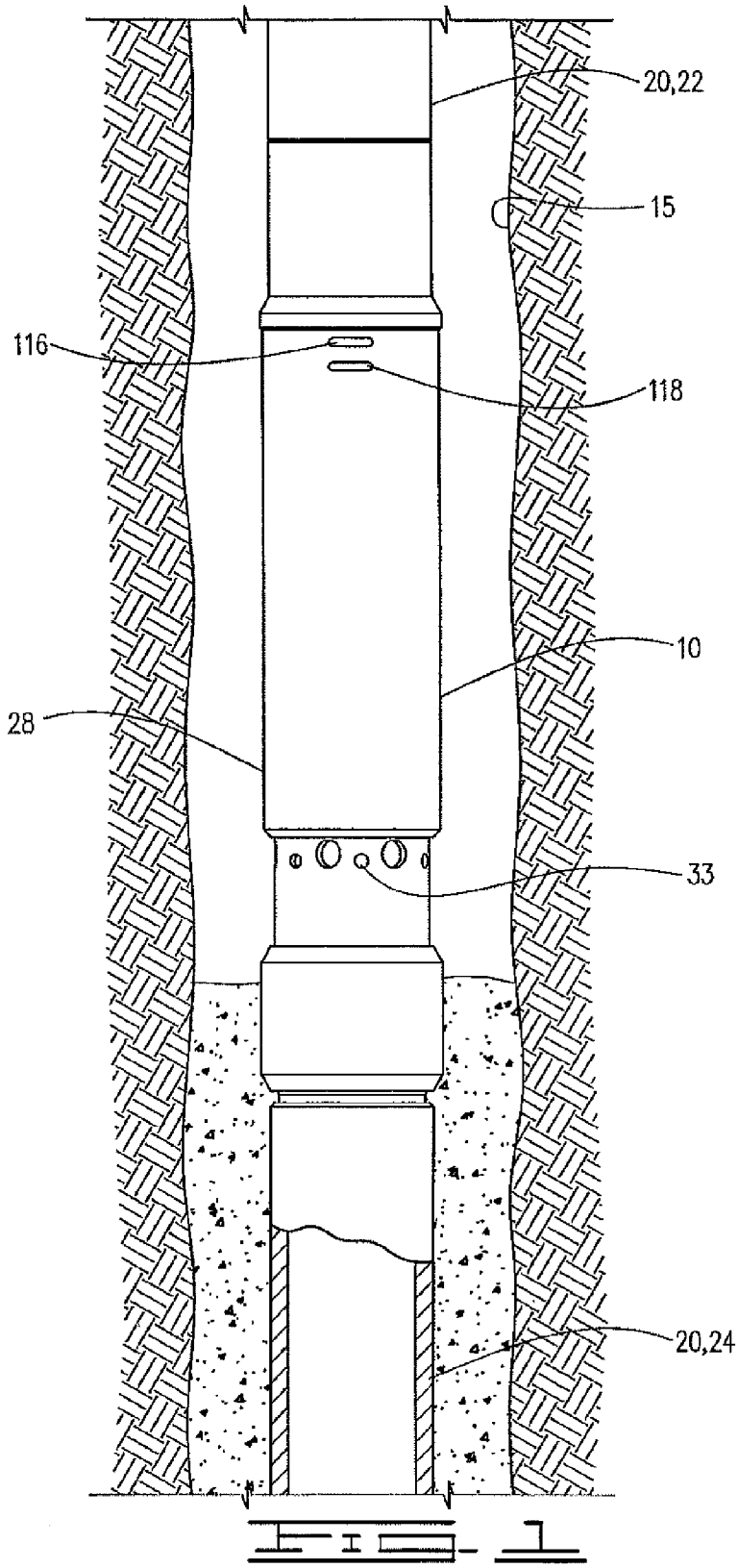
FIG. 1 is a schematic of the tool lowered into a well bore in which casing therebelow has been cemented.

The cementing tool of the current disclosure is designated in FIG. 1 with the numeral 10. Cementing tool 10 is shown disposed in a well bore 15 connected in a casing 20. Casing 20 and well bore 15 define an annulus 21 therebetween. Casing 20 may comprise an upper portion 22 and a lower portion 24. As is apparent from the drawing in FIG. 1, cement has been displaced into well bore 15 around lower portion 24 of casing 20. As will be described herein, stage cementing tool 10 may be utilized to cement upper portion 22 of casing 20 in well bore 15.

Referring now to FIGS. 2-6, cementing tool 10 comprises a housing 26, with a closing sleeve 28 slidably disposed thereabout. An operating sleeve 30 is slidably disposed in housing 26 and is detachably connected thereto with a plurality of shear pins 31 or other means known in the art. An opening sleeve 32 is slidably received in housing 26 and is detachably connected thereto with shear pins 33 or other means.

An external stop or retainer 34 is disposed about and connected to housing 26 and may be threadedly connected thereto. An inner or internal stop or retainer 36 is disposed in housing 26 and is attached thereto. Retainer 36 may be connected to housing 26 with lock rings 63 received in groove 64 defined in the inner surface of housing 26.

Figure 2:
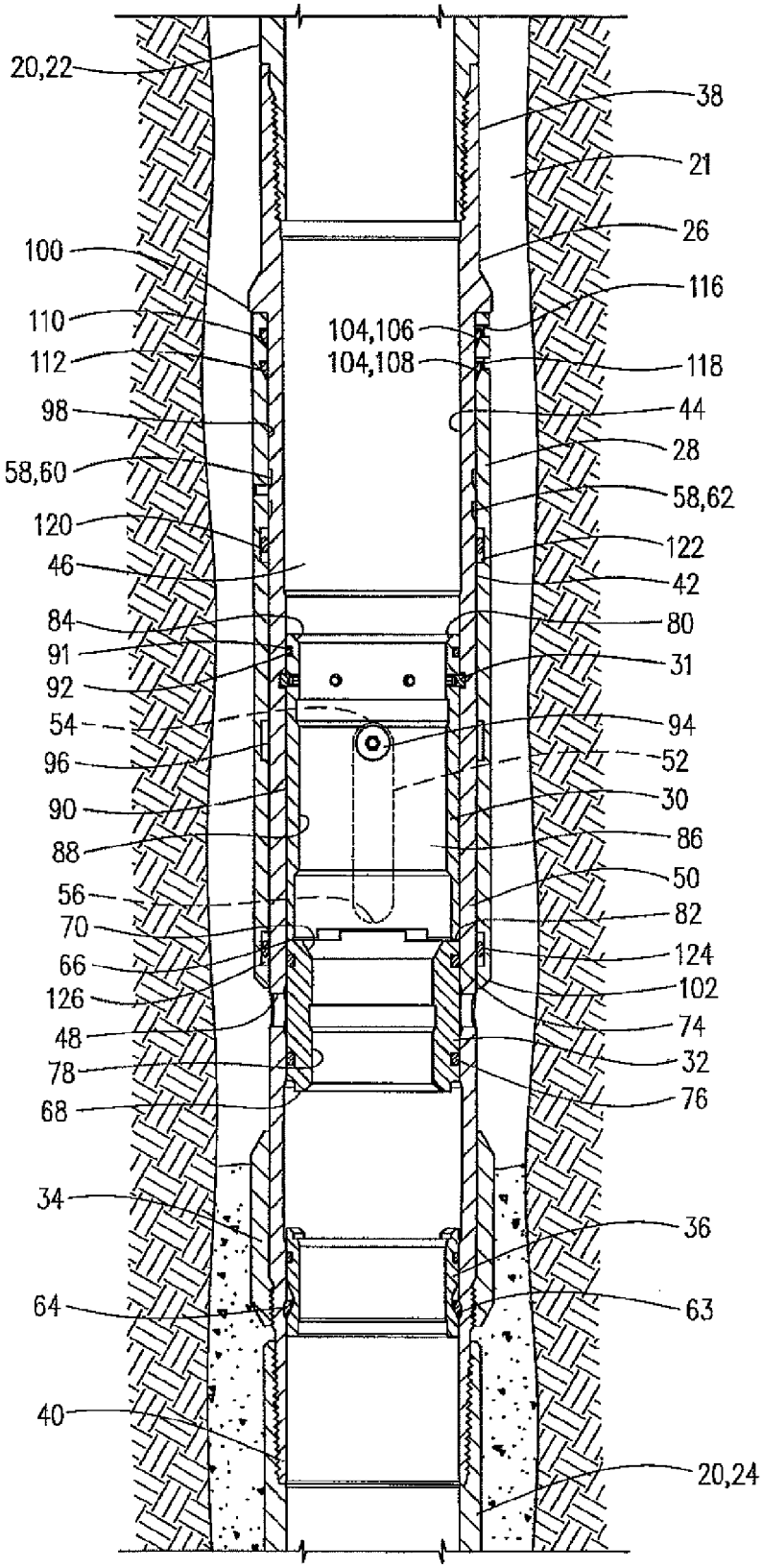
FIG. 2 is a cross section of the cementing tool before the opening sleeve has been engaged.
Figure 3:
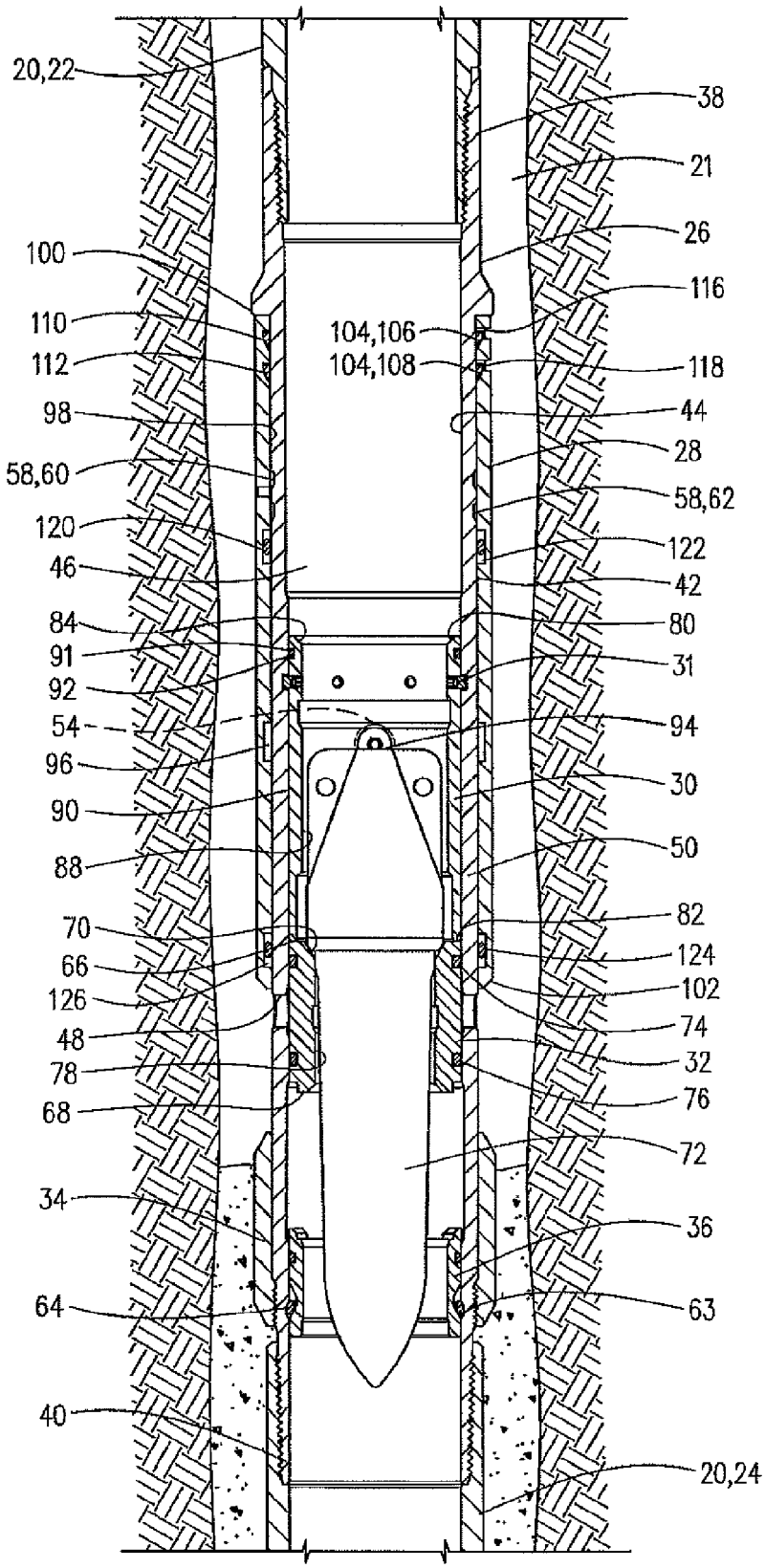
FIG. 3 is a cross section of the cementing tool after a freefall plug has engaged the opening seat.
Figure 4:
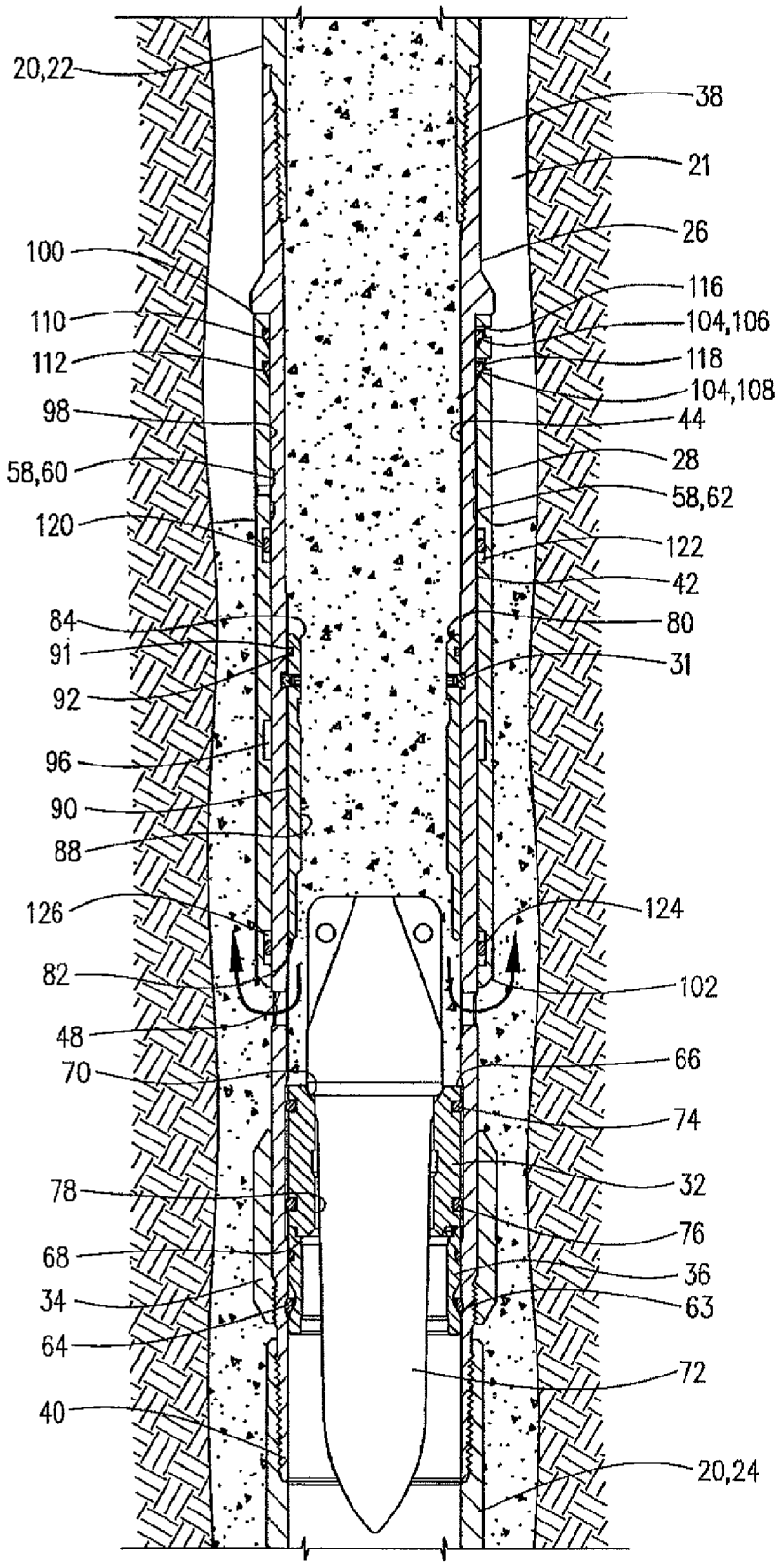
FIG. 4 is a cross section after the opening seat has moved, and cementing is displaced through the cementing port.

Housing 26 has upper end 38 which may have an internal thread thereon adapted to connect to the upper portion 22 of casing 20. Housing 26 has lower end 40 which may have external thread or otherwise be adapted to connect to lower portion 24 of casing 20. Housing 26 has an outer or external surface 42 and an inner surface 44 which defines longitudinal central flow passage 46. Housing 26 has at least one and preferably has a plurality of cementing ports 48 defined in a wall 50 thereof. Closing sleeve 28 is shown in FIGS. 2-4 in the open position in which it does not cover cementing ports 48. As will be explained in more detail hereinbelow, when the closing sleeve moves to its closed position, it will cover cementing ports 48 to prevent flow therethrough. Opening sleeve 32 is shown in its closed position in FIGS. 2 and 3 and is shown moved to its open position in FIG. 4 in which cementing port 48 communicates longitudinal central flow passage 46 with the annulus 21.

Housing 26 has a plurality of slots 52 defined in the wall 50 thereof. Slots 52 have upper end 54 and lower end 56. As will be described in more detail hereinbelow, pins or other locking elements will extend through the slots 52 to mechanically lock or attach operating sleeve 30 to closing sleeve 28. Housing 26 has at least one and preferably a plurality of locking receptacles 58, which may be grooves 58 in the outer surface 42 thereof. Grooves 58 may be referred to herein as locking grooves 58. In the embodiment of FIGS. 2-6, two grooves 58 may comprise a first or upper locking groove 60 and a second or lower locking groove 62.

Opening sleeve 32 has upper end 66, lower end 68 and has a seat 70 at upper end 66 thereof. Seat 70 is adapted to receive a plug which as explained in more detail may be a freefall plug 72 which is shown in FIGS. 3-6. Opening sleeve 32 is shown in the closed position in FIGS. 2 and 3 in which opening sleeve 32 covers cementing ports 48. Opening sleeve 32 is movable in housing 26 from the closed position shown in FIGS. 2 and 3 to the open position shown in FIGS. 4-6 in which the opening sleeve does not cover or prevent flow through cementing ports 48. In the closed position shown in FIGS. 2 and 3, O-ring seals 74 and 76 disposed about opening sleeve 32 are positioned above and below cementing ports 48 and will sealingly engage inner surface 44 of housing 26. Opening sleeve 32 has a central opening 78 therethrough.

Operating sleeve 30 has an upper end 80, a lower end 82 and has a seat 84 defined at the upper end 80 thereof. Operating sleeve 30 has a central opening 86 therethrough defined by inner surface 88. An outer surface 90 of operating sleeve 30 has a groove 91 with an O-ring seal 92 therein to sealingly engage inner surface 44 of housing 26. Operating sleeve 30 is initially detachably connected to housing 26 with shear pins 31. When opening sleeve 32 is in its closed position, lower end 82 of operating sleeve 30 may abut upper end 66 of opening sleeve 32. A plurality of connecting pins 94 are connected to operating sleeve 30 and will extend through longitudinal slots 52 into a groove 96 defined in inner surface 98 of closing sleeve 28. Operating sleeve 30 is thus mechanically locked to closing sleeve 28 such that longitudinal movement of operating sleeve 30 will cause closing sleeve 28 to move longitudinally along housing 26.

Closing sleeve 28 has upper end 100 and lower end 102. Cementing tool 10 has at least one and preferably a plurality of lock members 104 which may be identified as a first or upper lock member 106 and a second or lower lock member 108. In the embodiment described, lock members 106 and 108, which may be referred to as lock rings 106 and 108, are disposed in first or upper and second or lower retention grooves 110 and 112, respectively, defined in closing sleeve 28. Lock rings 106 and 108 are thus movable with, and carried by closing sleeve 28 and are disposed about housing 26. Tool 10 has at least one, and as described earlier herein, preferably has a plurality of locking receptacles 58 and in the embodiment shown has first or upper locking groove 60 and second or lower locking groove 62 defined on the outer surface 42 of housing 26.

The operation of the cementing tool 10 may be described with reference to FIGS. 1-6. As shown in FIG. 1, cementing tool 10 may be lowered into well bore 15 connected as part of a casing 20. Casing 20 is shown in FIG. 1 with the lower portion 24 thereof having been previously cemented by means known in the art. It will be understood that a float collar and/or float shoe arrangement may be located at the bottom or lower end of casing 20 and that cement will flow therethrough into the annulus 21 between well bore 15 and casing 20. Opening sleeve 32 will be in its closed position during cementing of lower portion 24 of casing 20, and closing sleeve 28 will be in its open or first position. Cement will flow through the bottom of casing 20, and a shutoff plug as is known in the art will pass through casing 20, including cementing tool 10 and will land above the float shoe/collar arrangement on a baffle adapter or other seat. The shutoff plug will be pumped through the casing with a displacement fluid.

After the lower portion 24 of casing 20 is cemented, freefall plug 72 may be dropped through casing 20 until it engages opening sleeve 32. Pressure is increased in casing 20, which will cause shear pins 33 to break and allow opening sleeve 32 to move downwardly until it engages internal retainer 36. FIG. 4 shows opening sleeve 32 moved downwardly to its open position so that cement can be flowed through cementing ports 48 into the annulus 21.

Once sufficient cement has been displaced into the casing a plug 114 is displaced through casing 20. Plug 114 is preferably a wiper plug that wipes the inside of casing 20 as it is displaced therethrough. As is known in the art, wiper plug 114 will be displaced with a displacement fluid. Increased pressure in the casing will cause shear pins 31 to break and move operating sleeve 30 downwardly, along with closing sleeve 28, and the closing sleeve 28 will move from the open position shown in FIG. 2 to a closed position.

The closed position as used herein means that closing sleeve 28 has moved downwardly on housing 26 a sufficient amount so that lower seal 124 in groove 126 is positioned below cementing ports 48 while seal 120 in groove 122 is positioned thereabove so that the closing sleeve 28 sealingly engages the housing 26 above and below cementing ports 48 to prevent flow therethrough.

Figure 5:
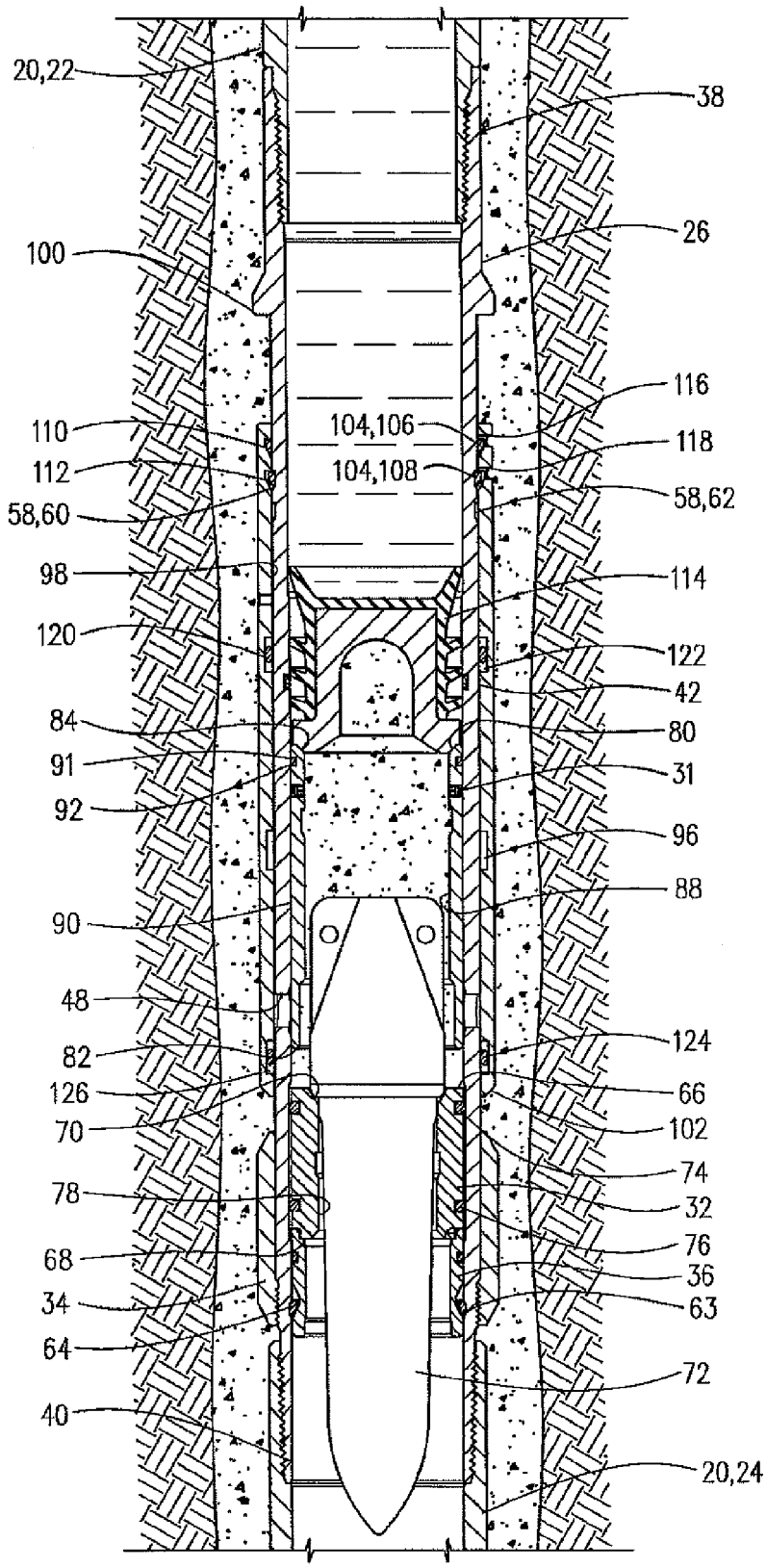
FIG. 5 is a cross-section view of the tool after a plug has engaged the operating sleeve to move the closing sleeve along the housing to a closed position.
Figure 5:
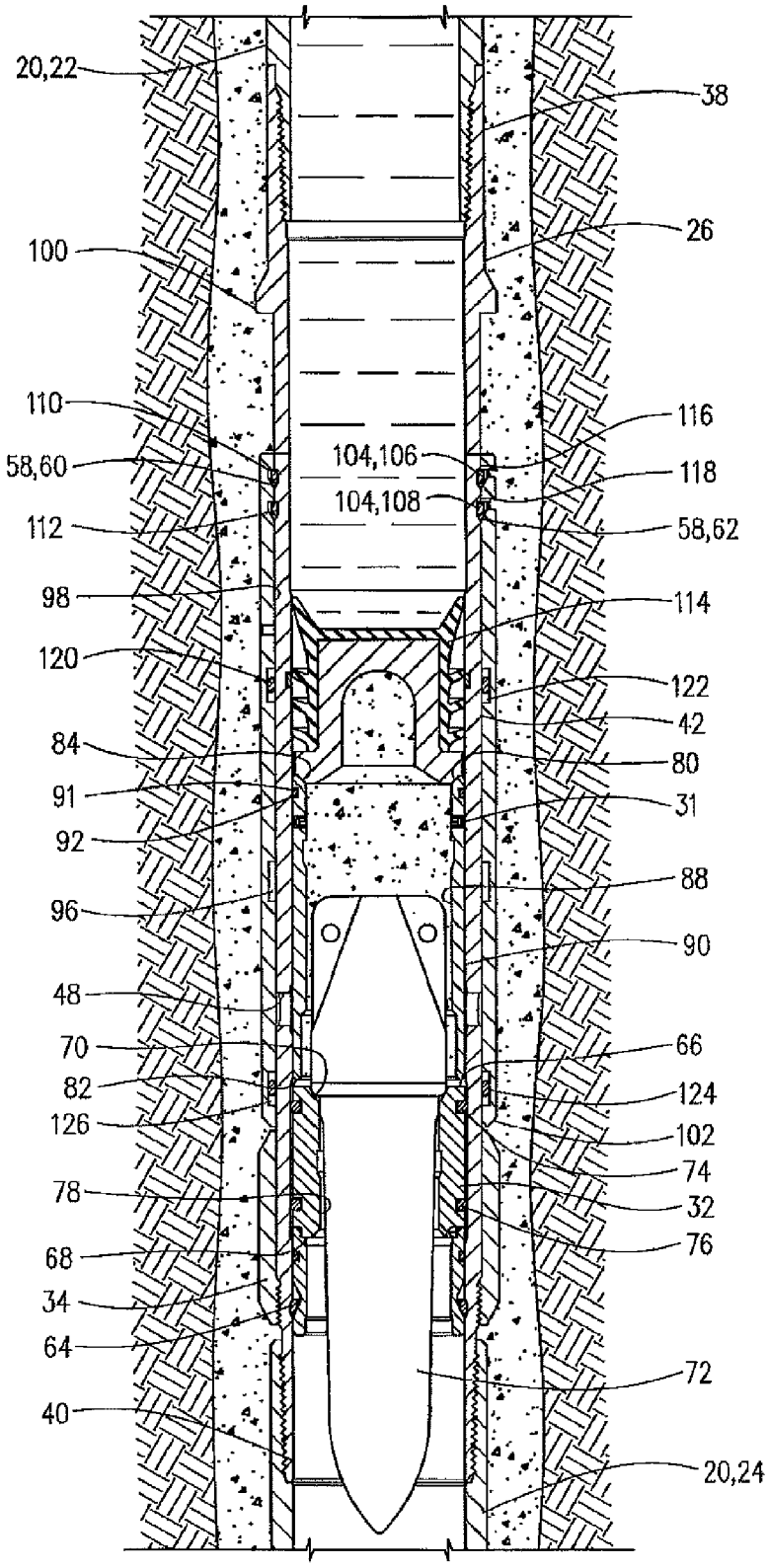

FIG. 5 shows cementing tool 10 after closing sleeve 28 has been moved such that the second or lower lock ring 108 has engaged upper locking groove 60. When closing sleeve 28 reaches such a position, it is locked in the closed position in that lock ring 108 will prevent upward movement of the closing sleeve 28 out of the closed position and thus will prevent leakage through cementing ports 48. While the closing sleeve 28 may still move downwardly, it is nonetheless locked in the closed position since it cannot move upwardly out of the closed position due to the locking engagement of lock ring 108 with locking groove 60. As apparent in FIG. 5, closing sleeve 28 has only traveled a portion of its full possible travel distance which is that distance from its position shown in FIG. 2 to the point at which lower end 102 of closing sleeve 28 engages, or nearly engages external retainer 34. Assuming full travel distance of closing sleeve 28, upper lock ring 106 will engage upper locking groove 60 in housing 26 and lower lock ring 108 will engage lower locking groove 62. Closing sleeve 28 will be locked in a closed position since upward movement of the closing sleeve 28 is prevented.

Cementing tool 10 thus has a redundant locking system in that it has a plurality of locking grooves or receptacles adapted to receive a plurality of lock members such that once closing sleeve 28 is in the closed position, the engagement of any lock member 104 with any locking receptacle 58 will lock closing sleeve 28 in a closed position to prevent upward movement thereof and thereby prevent leakage of the treatment fluid that may be pumped through casing 20 to treat zones through cementing ports 48. Leakage through cementing ports can cause degradation of the cement and can cause other concerns such as loss of zonal isolation. The locking system is redundant in that there is more than one opportunity for closing sleeve 28 to lock from the initial engagement of second lock ring 108 with first groove 60 to the last engagement which is the engagement of second lock ring 108 with second groove 62. First lock ring 106 will engage second locking groove 60 when second lock ring 108 engages second locking groove 62.

The redundant locking system insures that even if closing sleeve 28 does not complete its full travel, it may still be locked in the closed position. There are a number of reasons why full travel might be prevented including a buildup of debris on housing 26 above outer retainer 34. In addition, in the prior art, a lock ring was included at or near a lower end of a closing sleeve and was adapted to engage a groove that was in the housing below the cementing ports. The locking groove in the prior art was uncovered and exposed and had a tendency to gather debris which would prevent the lock ring from properly engaging the groove.

Cementing tool 10 of the current disclosure has locking receptacles 58 that are completely covered by closing sleeve 28 and are protected from the well bore. Thus, debris cannot gather in locking receptacles 58, which are optimally located for proper engagement of lock rings 104. Locking receptacles 58 are completely covered when closing sleeve 28 is in the open position, and will be completely covered during the engagement of any of lock rings 104 with any of grooves 58 except for circumferential slots 116 and 118 which provide access to lock rings 58. During movement of closing sleeve 28 to the closed position, all of the plurality of locking receptacles 58 are completely covered. As described herein, once closing sleeve 28 has reached a closed position, the engagement of any of lock rings 104 with any of locking grooves 58 will lock closing sleeve 28 in the closed position such that upward movement of the closing sleeve to uncover or partially uncover cementing ports 48 is prevented, and cementing ports 48 will be located between seals 120 and 124.

Figure 7:
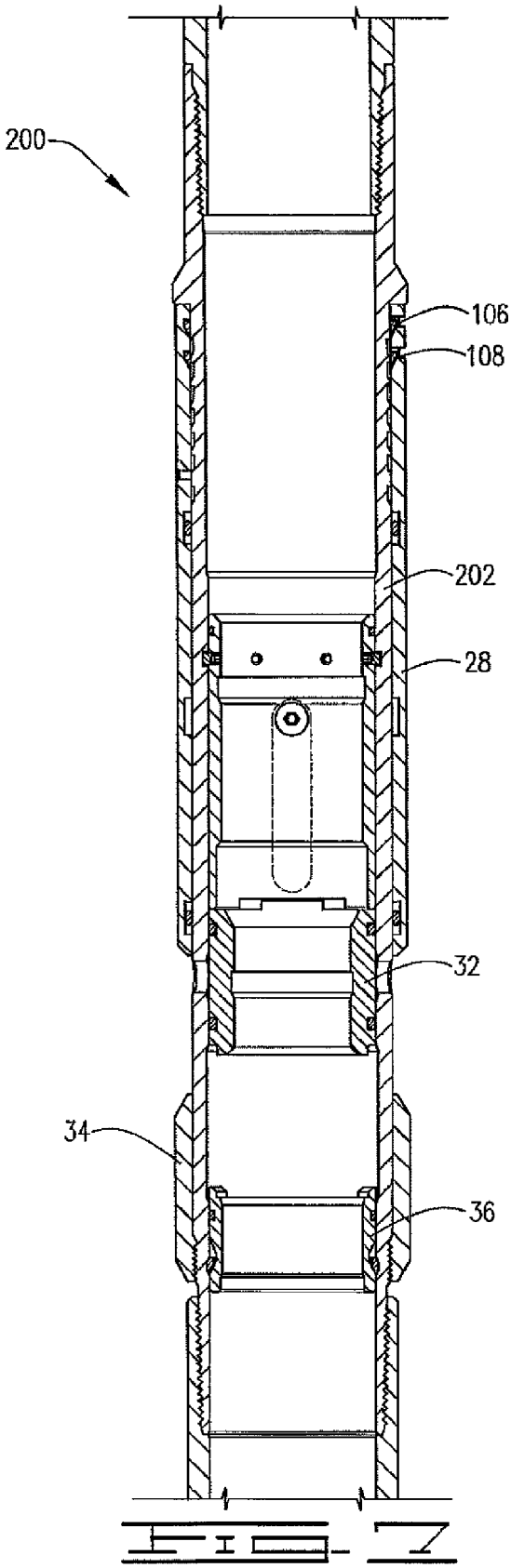
FIGS. 7 and 8 are cross-section views of a second embodiment of a cementing tool.
Figure 8:
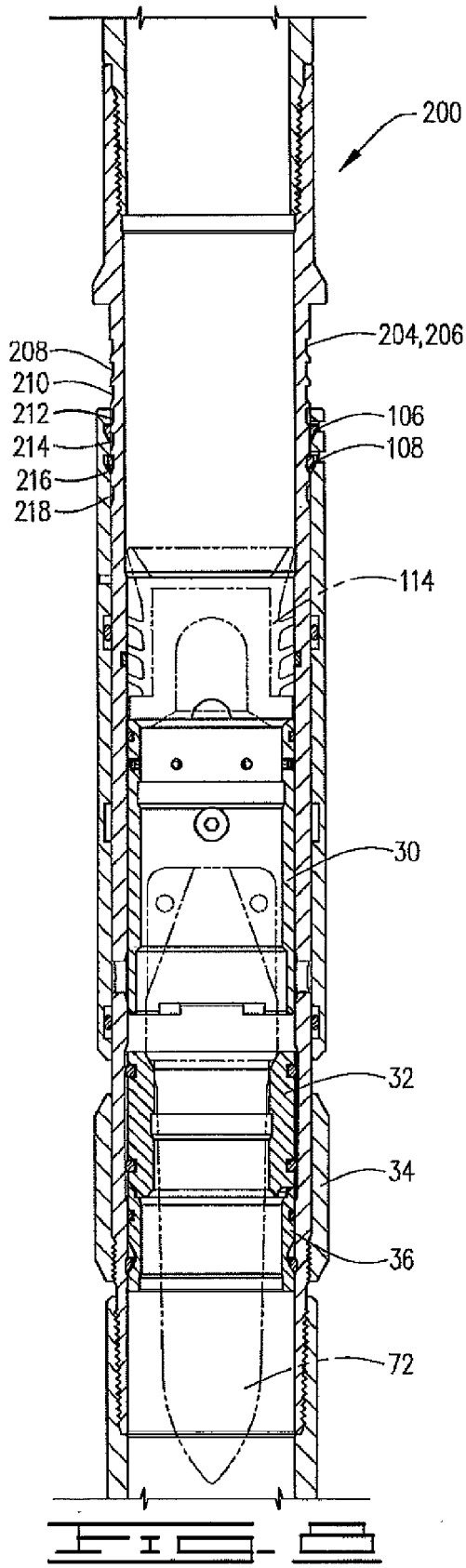

The embodiment of FIGS. 7 and 8 is similar to the embodiment of FIGS. 2-6 and may be referred to as tool 200. The details of tool 200 are substantially identical to the details of tool 10, except that in tool 200, the housing, which will be referred to as housing 202 has a plurality of locking receptacles 204, which provide a ratcheting effect. Receptacles 204, which may be referred to as locking grooves 204, will receive lock members 106 and 108, so that when either of lock members 106 and 108 are received in any of locking receptacles 204, upward movement of closing sleeve 28 relative to housing 202 is prevented. The embodiment of FIGS. 7 and 8 has seven receptacles 204, which may include receptacles 206, 208, 210, 212, 214, 216 and 218, but more or less than seven may be included. When closing sleeve 28 moves to the closed position, and either of lock members 106 and 108 are received in any of the receptacles 204, closing sleeve 28 is locked in the closed position. Closing sleeve 28 is in the closed position in FIG. 8, but as is apparent, may still move downwardly its full travel, and will still be locked in a closed position. All of grooves 204 which will lock sleeve 28 in a closed position are covered by sleeve 28 in the open position thereof and so are protected and isolated from the well. As such, no debris can gather in any of such receptacles prior to being engaged by either of lock members 106 or 108.

Figure 9:
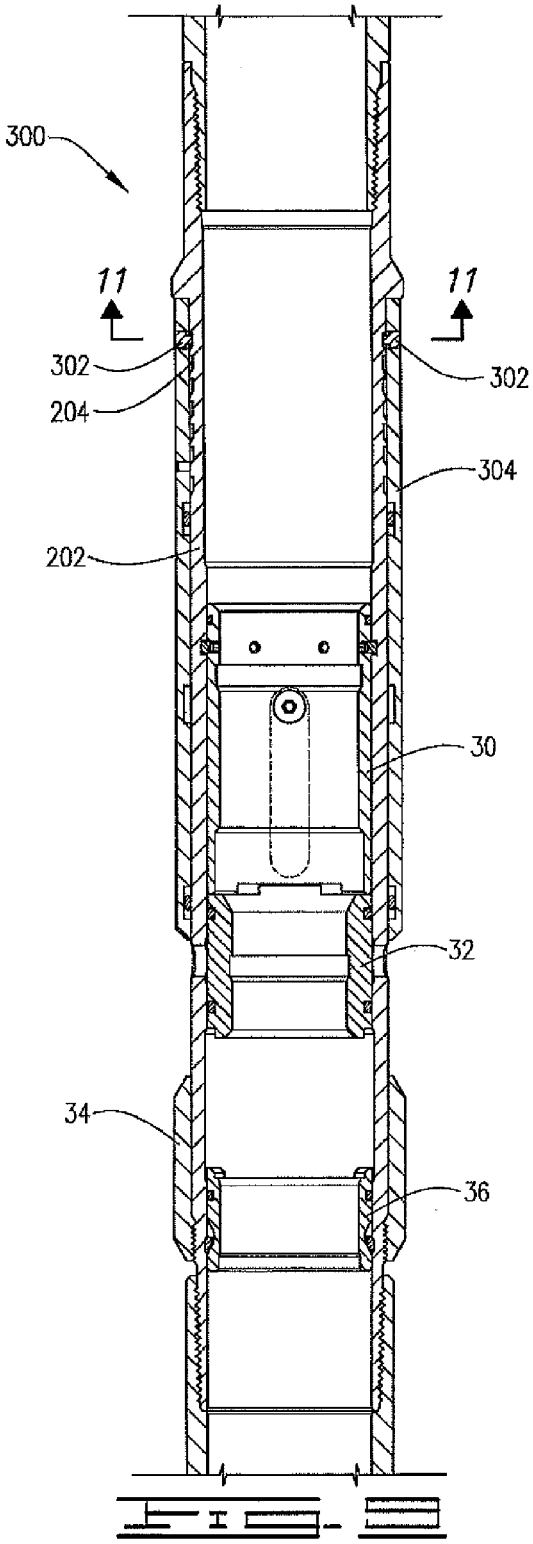
FIGS. 9 and 10 are cross-section views of a third embodiment of a cementing tool.
Figure 10:
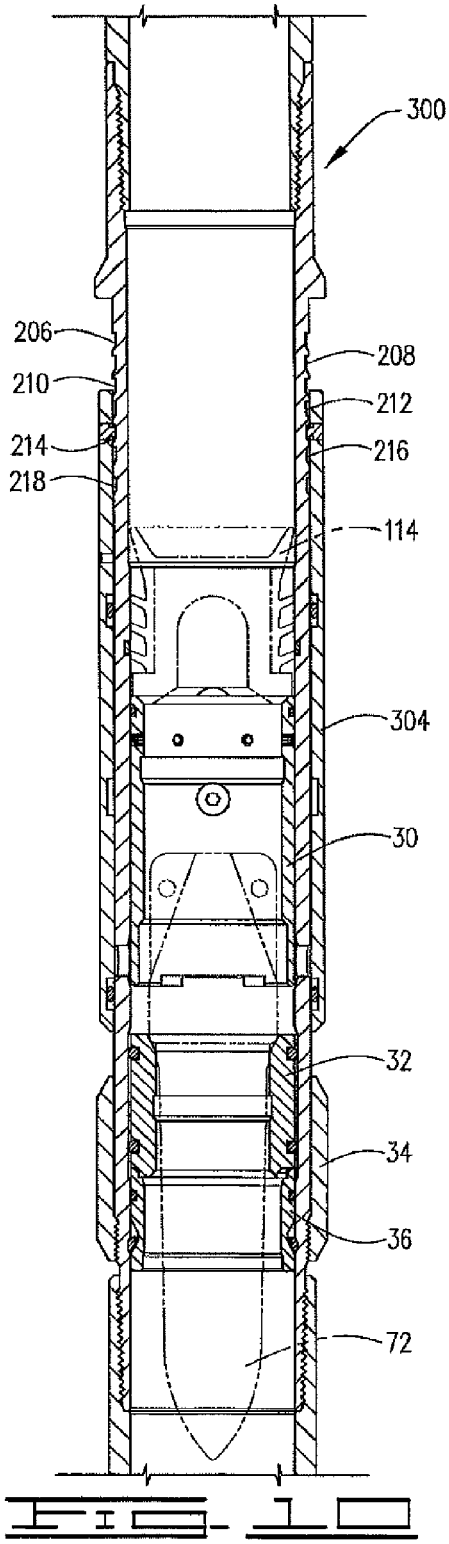
Figure 11:
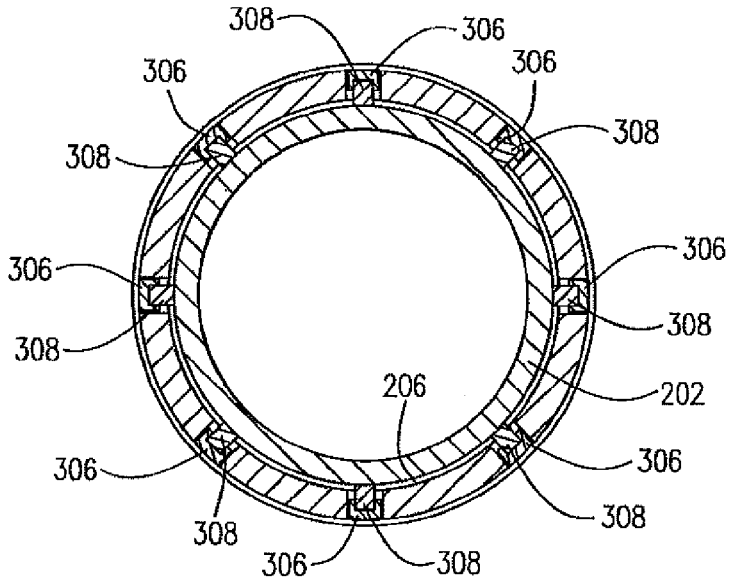
FIG. 11 is a view from line 11-11 of FIG. 9.
Figure 12:
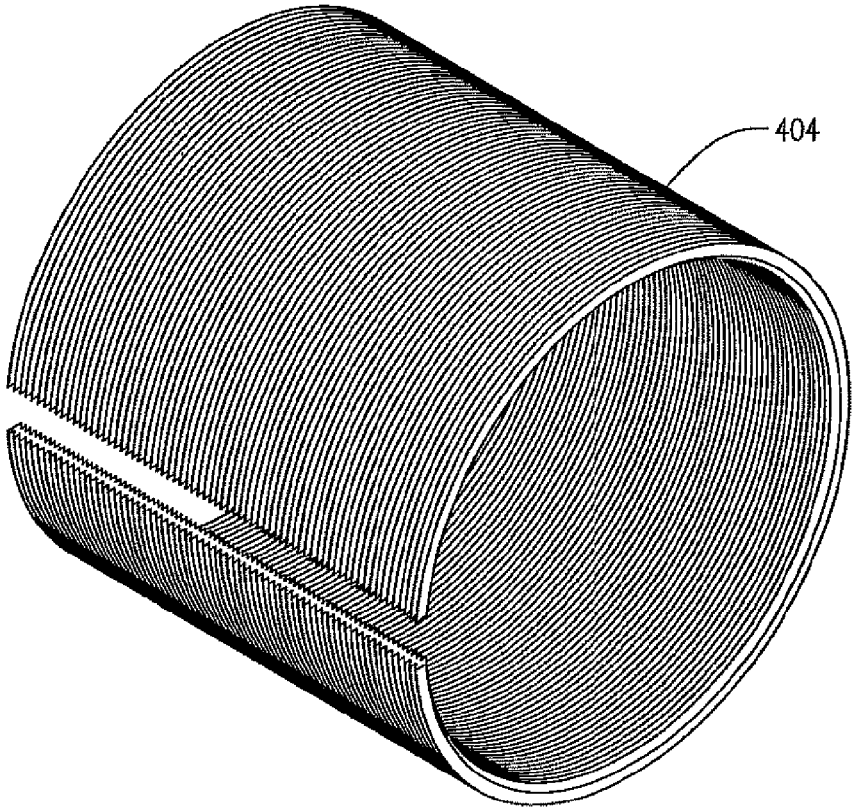
FIG. 12 is a perspective of a ratchet sleeve.

The embodiment of FIGS. 9-11 is similar to that of FIGS. 7 and 8, and will be referred to as tool 300. Tool 300 is generally identical to tool 200, except that the closing sleeve has a plurality of spring-loaded, circumferentially spaced lock members 302. The closing sleeve in tool 300 may be referred to as closing sleeve 304. As is apparent from the drawings, tool 300 includes the housing 202 with the plurality of receptacles 204. Circumferentially spaced lock members 302, when received in a lock receptacle 204, will prevent closing sleeve 304 from moving upwardly relative to housing 202. Thus, when closing sleeve 304 moves to the closed position, and lock members 302 are received in one of lock receptacles 204, closing sleeve 304 is prevented from upward movement, and is locked in the closed position. In FIG. 10, closing sleeve 304 is in the closed position but has not traveled its full travel distance on housing 202. Closing sleeve 304 may still move downwardly, in which case lock members 302 will engage another of lock receptacles 204, for example, receptacle 216 or 218, and will lock closing sleeve 304 in the closed position. While the embodiment of FIGS. 10-12 shows a single row of circumferentially spaced members 302, the tool may include a plurality of longitudinally spaced rows of circumferentially spaced lock members 302. Lock members 302 may be for example, Shortie Spring Plungers available from Jergens, Inc., threaded into closing sleeve 304. Lock members 302 may include a threaded body 306, with a plunger 308 biased toward housing 202.

Figure 13:
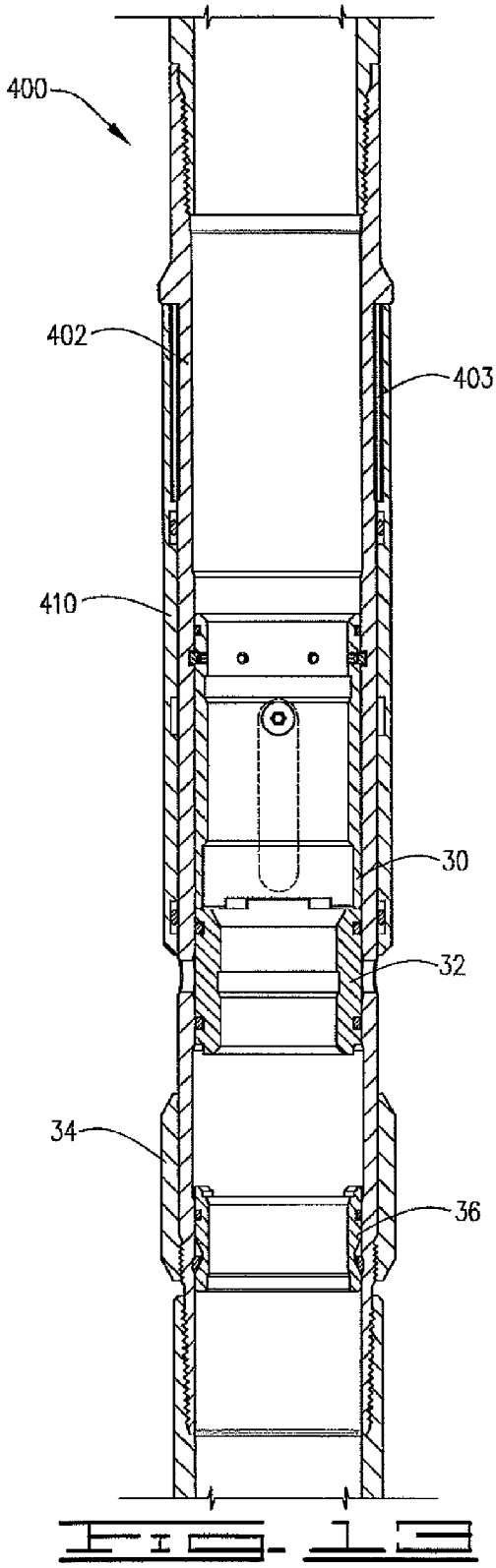
FIGS. 13 and 14 are cross-section views of a fourth embodiment of a cementing tool.
Figure 14:
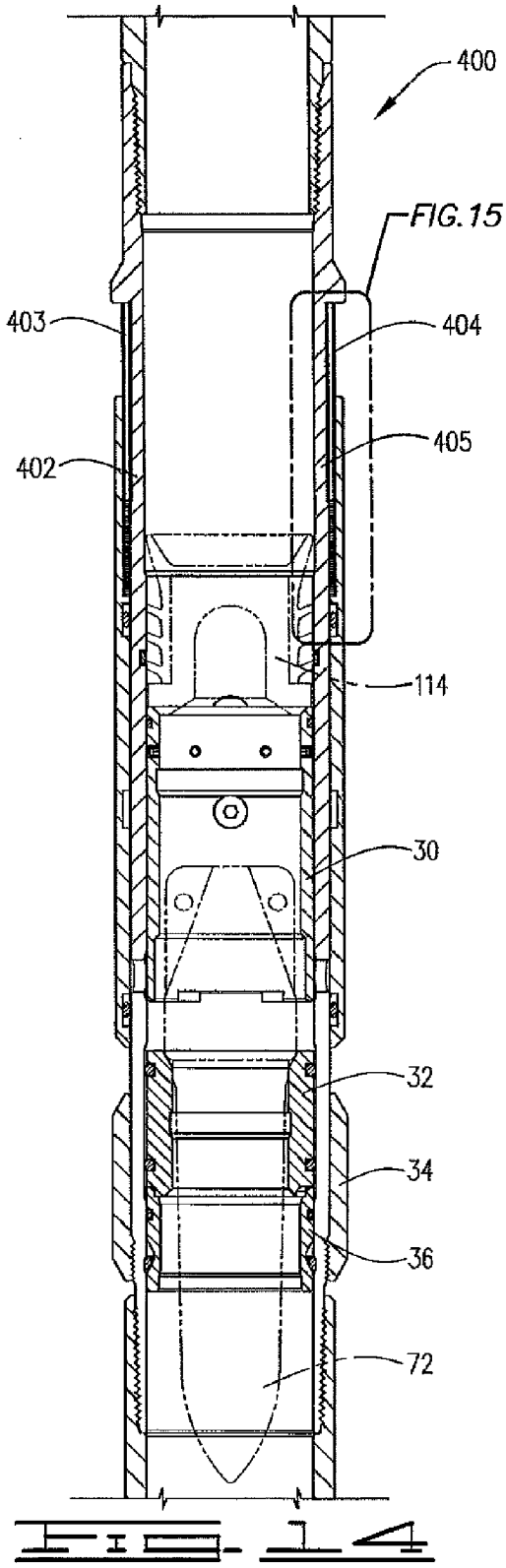
Figure 15:
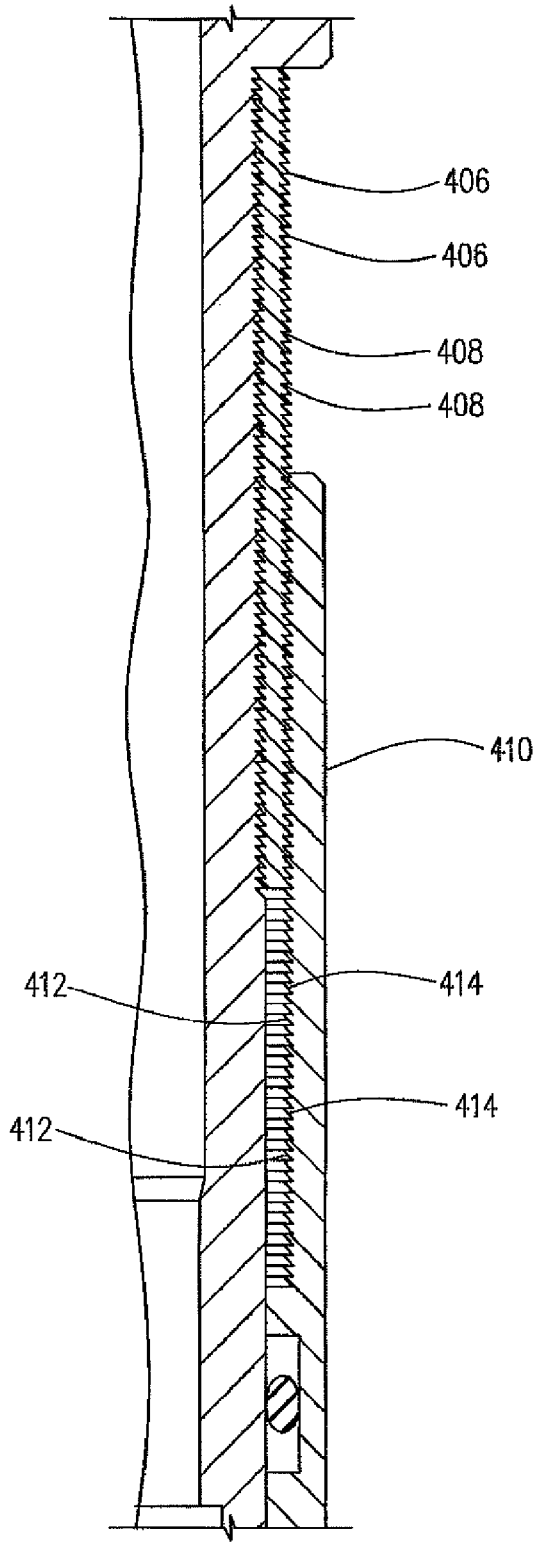
FIG. 15 is an enlarged view of a portion of the closing sleeve and housing of the embodiment of FIGS. 13 and 14.

An additional embodiment of a cementing tool 400 is shown in FIGS. 13 and 14. Tool 400 is similar to tool 10, and its features are generally identical thereto, except that tool 400 has a housing 402 with outer surface 403. Housing 402 includes a sleeve 404, that may be referred to as a ratcheting sleeve, affixed to a housing body 405. Sleeve 404 may be threaded to housing 402, or connected by other means known in the art. Ratcheting sleeve 404 has a plurality of teeth 406 with grooves, or receptacles 408 therebetween. Closing sleeve 410 likewise has a plurality of teeth 412, which may be referred to as lock members, with grooves 414 therebetween. Teeth 412 will be received in, and will mate with grooves 408, and will prevent upward movement of closing sleeve 410 relative to housing 402. When closing sleeve 410 moves downward to a closed position, like that in FIG. 14, the engagement of teeth 412 with grooves 408 defined on outer surface 403 will prevent upward movement, and lock closing sleeve 410 in the closed position. Closing sleeve 410 can move downwardly from the position of FIG. 14, but cannot move upwardly. Thus, the engagement of any of teeth 412 with any of grooves 408 when closing sleeve 410 is in the closed position will lock closing sleeve 410 in the closed position. In its open position, closing sleeve 410 covers grooves 408 to protect the grooves and to isolate the grooves 408 from the wellbore, thus preventing the buildup of debris therein. Grooves 408 that are engaged when closing sleeve 410 is in the closed position are completely covered by the closing sleeve when it is in the open position, and when closing sleeve 410 is in the closed position.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A cementing tool for use in a well comprising:
- a housing defining a central flow passage and having at least one cementing port in a wall thereof;
- a closing sleeve received about the housing and movable from a first position to a second position, wherein the closing sleeve covers the at least one cementing port in the second position and does not cover the at least one cementing port in the first position; and
- a lock member movable with the closing sleeve, the lock member being engagable with a locking receptacle to prevent the closing sleeve from moving upward relative to the housing, the locking receptacle being covered by the closing sleeve when the closing sleeve is in the first position.

2. The cementing tool of claim 1, wherein the locking receptacle is positioned above the at least one cementing port.

3. The cementing tool of claim 1, comprising a plurality of locking receptacles defined on the outer surface of the housing.

4. The cementing tool of claim 3, the plurality of locking receptacles being covered by the closing sleeve in the first position thereof.

5. The cementing tool of claim 4, the locking receptacles comprising a plurality of longitudinally spaced locking grooves in the outer surface of the housing, the locking grooves being covered by the closing sleeve in the first position thereof.

6. The cementing tool of claim 5, comprising a plurality of the lock members movable with the closing sleeve, wherein engagement of any of the lock members with any of the locking grooves after the closing sleeve has moved to the second position will prevent upward movement of the closing sleeve relative to the housing to prevent the closing sleeve from moving out of the second position.

7. The cementing tool of claim 6, the lock members comprising a plurality of lock rings movable with the closing sleeve, each lock ring being longitudinally spaced from the adjacent lock ring.

8. The cementing tool of claim 6, wherein at least some of the plurality of locking grooves are positioned above the at least one cementing port.

9. The cementing tool of claim 8, wherein all of the locking grooves and lock rings are positioned above the cementing port.

10. The cementing tool of claim 5, the lock members comprising a plurality of circumferentially spaced lock members carried by the closing sleeve.

11. A cementing tool for use in a well comprising:
- a housing defining a central flow passage and having at least one cementing port in a wall thereof for communicating the central flow passage with a well annulus;
- a closing sleeve received about and detachably connected to the housing in an open position in which the closing sleeve does not block flow through the at least one cementing port, the closing sleeve being movable from the open position to a closed position in which the closing sleeve blocks flow through the at least one cementing port;
- an operating sleeve disposed in the housing and connected to the closing sleeve, wherein the housing has a plurality of locking receptacles defined therein above the at least one cementing port; and
- a plurality of lock members movable with the closing sleeve, wherein the lock members will prevent upward movement of the closing sleeve to prevent the closing sleeve from moving out of the closed position when any of the lock members are received in any of the plurality of locking receptacles once the closing sleeve has moved to the closed position.

12. The cementing tool of claim 11 wherein the locking receptacles are covered by the closing sleeve in the open position of the closing sleeve.

13. The cementing tool of claim 12, the lock members comprising lock rings and the locking receptacles comprising locking grooves.

14. The cementing tool of claim 11, the lock members comprising longitudinally spaced lock rings, and the locking receptacles comprising longitudinally spaced locking grooves defined on the housing.

15. The cementing tool of claim 14 wherein the plurality of lock rings are carried by the closing sleeve.

16. The cementing tool of claim 14, the closing sleeve having a full travel distance along the housing, wherein at least one of the plurality of lock rings will engage one of the plurality of locking grooves when the closing sleeve is in the closed position to lock the closing sleeve in the closed position prior to the full travel distance of the closing sleeve.

17. The cementing tool of claim 11, wherein the locking receptacles comprise locking grooves on the outer surface of the housing, and the lock members comprise teeth engagable with the locking grooves.

18. The cementing tool of claim 17, wherein the teeth are defined on the closing sleeve.

19. The cementing tool of claim 11, the lock members comprising a plurality of plungers carried by the closing sleeve and movable therewith.

20. A cementing tool for use in a well comprising:

an outer housing defining a central flow passage, and having a cementing port for communicating the central flow passage with a well annulus;

a closing sleeve movable from an open position in which the cementing port is not covered by the closing sleeve to a closed position in which the closing sleeve covers the cementing port;

a redundant locking system for preventing the closing sleeve from moving out of the closed position; the redundant locking system comprising a plurality of locking receptacles defined on the housing, and a plurality of lock members movable with the closing sleeve and receivable in the locking receptacles;

an operating sleeve disposed in the housing, the closing sleeve being disposed about the housing; and a plurality of connectors extending through slots in the housing to connect the operating sleeve to the closing sleeve.

21. A cementing tool for use in a well comprising:

an outer housing defining a central flow passage, and having a cementing port for communicating the central flow passage with a well annulus;

a closing sleeve movable from an open position in which the cementing port is not covered by the closing sleeve to a closed position in which the closing sleeve covers the cementing port;

a redundant locking system for preventing the closing sleeve from moving out of the closed position; the redundant locking system comprising a plurality of locking receptacles defined on the housing, and a plurality of lock members movable with the closing sleeve and receivable in the locking receptacles;

wherein the plurality of locking receptacles being defined on the outer surface of the housing, and the lock members being carried by the closing sleeve.

22. The cementing tool of claim 21, wherein the locking receptacles are not exposed to the wellbore when the closing sleeve is in the open position.

23. The cementing tool of claim 22, the locking receptacles being covered by the closing sleeve when the closing sleeve is in the open position.

24. The cementing tool of claim 21 wherein the locking receptacles comprise locking grooves defined on the housing.

25. The cementing tool of claim 24, the lock members comprising lock rings carried by the closing sleeve.

26. The cementing tool of claim 25, wherein at least one of the plurality of lock rings will engage one of the plurality of locking grooves to prevent the closing sleeve from moving out of the closed position.

27. The cementing tool of claim 25, the locking grooves comprising a plurality of longitudinally spaced locking grooves on an outer surface of the housing, the lock rings comprising a plurality of longitudinally spaced lock rings carried by the closing sleeve.

28. The cementing tool of claim 21, wherein the closing sleeve will be locked in the closed position when any of the plurality of lock members engage any of the plurality of the locking receptacles, once the closing sleeve has reached the closed position.

* * * * *